United States Patent [19]

Boyes

[11] 4,382,425

[45] May 10, 1983

[54] HEAT EXCHANGER

[75] Inventor: Michael Boyes, Derby, England

[73] Assignee: Stelrad Group Limited, Oxfordshire, England

[21] Appl. No.: 266,020

[22] PCT Filed: Mar. 6, 1979

[86] PCT No.: PCT/GB79/00041

§ 371 Date: Nov. 8, 1979

§ 102(e) Date: Nov. 7, 1979

[87] PCT Pub. No.: WO79/00726

PCT Pub. Date: Oct. 4, 1979

[30] Foreign Application Priority Data

Mar. 8, 1978 [GB] United Kingdom ..... 9132/78

[51] Int. Cl.[3] ..... F22B 23/06; F22B 37/10

[52] U.S. Cl. ..... 122/367 R; 122/367 A; 122/367 C; 165/125

[58] Field of Search ..... 122/367 R, 367 A, 367 C; 165/125

[56] References Cited

U.S. PATENT DOCUMENTS

| | | | |
|---|---|---|---|
| 1,761,397 | 6/1930 | Karmazin | 165/125 |
| 1,872,785 | 8/1932 | Modine | 165/125 |
| 2,163,199 | 6/1939 | Hart | 122/367 R |
| 3,204,693 | 9/1965 | Kuhn | 165/125 |
| 3,605,702 | 9/1971 | Thompson | 122/367 R |
| 3,701,340 | 10/1972 | Miller | 122/367 C |
| 3,978,919 | 9/1976 | Fachbach et al. | 165/125 |
| 3,981,354 | 9/1976 | Haberski | 165/125 |
| 4,055,152 | 1/1977 | Vidalenz | 122/367 C |
| 4,062,401 | 12/1977 | Rindny et al. | 165/125 |
| 4,222,350 | 9/1980 | Pompei et al. | 122/367 C |
| 4,252,087 | 2/1981 | Kime | 122/367 R |
| 4,282,833 | 8/1981 | Giesen | 122/367 C |
| 4,301,862 | 11/1981 | McAlister | 122/367 A |

FOREIGN PATENT DOCUMENTS

| | | |
|---|---|---|
| 2100344 | 7/1971 | Fed. Rep. of Germany . |
| 2315667 | 1/1977 | France . |
| 1284642 | 8/1972 | United Kingdom . |
| 1536146 | 12/1978 | United Kingdom . |

*Primary Examiner*—Henry C. Yuen

*Attorney, Agent, or Firm*—Diller, Ramik & Wight

[57] ABSTRACT

A hot water boiler, particularly for central heating and hot water supply in small dwellings where an economic unit with an output less than about 0.3 megajoule/hr (30,000 but/hr) is required, has a compact, cylindrical heat exchanger (110) with central combustion chamber (20) and forced draught. Water circulates through double-pass longitudinal waterways (12) in the monobloc heat exchanger body (111), in crossflow relationship to hot gases forced through short, narrow, annular radial passages (23). One or more walls (22) separating these passages may be replaced by a hollow wall within which water can circulate, increasing the heat exchange surface available.

1 Claim, 8 Drawing Figures

HEAT EXCHANGER

TECHNICAL FIELD

The technical field of this invention comprises boilers for producing hot water, such a boiler including a heat exchangers for indirect heat exchange between hot combustion gases and water and a second fluid medium, the heat exchanger comprising a generally cylindrical hollow body having longitudinal passage means for said water, said heat exchanger being adapted for flow of said combustion gases within the hollow body away from the axis of said body and towards its circumference and having a heat exchange matrix through which the gases must pass during such flow and through which said longitudinal passage means extend. Such a heat exchanger will be referred to herein as a "heat exchanger of the kind hereinbefore specified".

Such boilers are intended for use in a central heating system, or for producing hot water for other purposes, or both.

BACKGROUND ART

Hot water boilers for production of domestic hot water or hot water for a central heating system, conventionally comprise a segmental, cast-iron heat exchanger which is typically of a somewhat rectangular configuration and which has a combustion zone below it. Fuel, such as gas or oil, and air are fed to a burner in the combustion zone and there burnt so that the hot combustion gases rise generally upwardly through the heat exchanger, to be discharged, typically, at the top or at the back of the latter. In such a heat exchanger, the water passages may follow any desired or convenient path, usually partly horizontal and partly vertical.

Boilers of this conventional kind have been made in large quantities, down to very small sizes. In particular, small boilers for mounting on a wall are used in small houses and flats quite extensively, to provide the modest amount of hot water needed for supplying the radiators in two or three rooms and for supply to the hot water taps of the dwelling. Whilst such boilers are found to perform, in general, quite satisfactory, their manufacturing cost is higher per kilowatt of power output than that of larger units having a higher power output. This is because many factors in the manufacturing cost, as is well known, either do not vary with the power output of the unit being manufactured, or else are not proportional to its power output.

Boilers of conventional construction, having generally-rectangular heat exchangers of cast-iron, are in use having power outputs of the order of 0.42 megajoule/hr (40,000 btu per hour), but it is not economic to manufacture such boilers for outputs very much smaller than this.

However, provision of a boiler having a substantially greater heating capacity than the system calls for is generally wasteful, particularly in that such a boiler will tend to use more fuel that it need do. At the same time, there are many situations where boilers having a heating or power output capacity of about, or substantially smaller than, 0.3 megajoule/hr could be used with advantage. Examples of such situations include one-room or two-room flats, very small terrace or semi-detached houses. This is particularly so since recent escalations in building costs have driven developers of property to build smaller and smaller dwellings, in which space for any kind of appliance is scarcer than in the past, but where nevertheless there is a requirement for central heating as well as hot water for other purposes.

Reduced heating capacity is not, however, confined to small buildings, but is becoming possible more and more in buildings of all sizes, old and new, as the application of modern thermal insulation techniques reduces very substantially the heat losses and therefore the heating requirement.

Another consideration is that of size. A central heating system having a small heat input requirement will in general be installed in a place where space is limited, such as a small flat or apartment. Although the recent advent of wall mounted boilers has to a certain extent alleviated the problem of finding space for the boiler, in that it no longer needs to be placed on the floor, wall space may also be difficult to find in a small room. This is particularly so since any boiler requires a certain amount of free space around it to allow proper circulation of air for safety reasons. Again, since the boiler requires to be installed where a proper flue can be fitted, this in practice usually means that the choice of wall is limited to an outside wall where a suitable flue, either of the balanced type or otherwise, can be arranged.

It is thus desirable—and particularly for boilers of the smaller power output ranges—that the boiler, including its casing and accessories such as control unit, pump (if any), and pipe connections, shall be as small as possible, so that the likelihood is increased that it can be found a suitable position in a small room where a flue can be conveniently placed and where cold water, and gas or oil, can easily be brought to the boiler.

Proposals for "compact" boilers of comparatively small power output have been made in the past. In one such boiler, the shell-type heat exchanger is of fabricated construction and cylindrical in shape. A gas burner is mounted coaxially in the heat exchanger shell, and combustion air is supplied to the burner by a fan. Longitudinally extending pipes, arranged on a common pitch circle, are arranged through the heat exchanger shell to serve as water passages, and the hot combustion gases flow outwardly and freely from the burner towards the circumference of the shell, there to be collected and directed to the flue. Arranged between each water pipe and the next within the shell, there is a matrix of balls, so that the hot gases, to reach the outer circumference of the shell, have to pass through these matrices. Heat exchange from the hot gases to the water in the pipes thus takes place mainly through the balls and thence to the pipe walls. This ball matrix type of boiler has many promising features, but it has not yet been found possible to develop it to a stage at which it can be competitive with a conventional boiler.

DISCLOSURE OF INVENTION

It is a principal object of the invention to provide a boiler for heating water for central heating and/or other purposes, which can be made in sizes such that the power output may be substantially smaller than in conventional boilers for hot water, but which can be made relatively inexpensively whilst being at the same time robust and of satisfactory reliability and efficiency.

Another object of the invention is to provide, for such a boiler, a heat exchanger which can be made in conventional materials and which is essentially simple in design.

A further object of the invention is to provide such a boiler of compact form such that, having regard to its heating capacity, it can be made small enough to be conveniently installed in a very restricted space.

Principal advantages of the invention with reference to the background art reside in the achievement of the above-mentioned objects. To this end, a boiler according to the invention is of the kind having, a heat exchanger of the kind hereinbefore specified whose body has a number of radial passages, narrow relative to their radial length, these passages leading from a central bore of the body to an annular, circumferential space which serves as a manifold chamber for the first medium. The arrangement is such that the first medium passes between the bore and the annular space along a comparatively short path but in contact with a relatively large surface area constituted by the sides of the radial passages, being constrained in axial directions but free to flow in radial directions. The radial passages, each of which has the form of a segment of an annulus, are intersected by transverse walls which enclose longitudinal passage through which the second medium flows.

The invention provides that in the structure just described, at least one of the radial walls of the matrix, separating one radial passage from another, is hollow, having an annular passage extending circumferentially within the radial wall and connected with the longitudinal passages. This permits the second medium to circulate not only in the latter, but also in the annular interior of the (or each) hollow wall, thus substantially increasing the surface area available for heat transfer between the two fluids. The hollow cylindrical space within the heat exchanger bore constitutes a combustion chamber from which hot gaseous products of combustion of a fuel/air mixture pass through the radial passages of the heat exchanger to the annular circumferential space already mentioned, giving up their heat in the process to water flowing in the longitudinal passages and in the hollow walls, if provided, which separate one radial hot gas passage from another. It is envisaged that in a boiler according to the invention, a forced draught is required. To this end, the boiler incorporates a fan or blower, which may be mounted in the combustion chamber itself or in the air inlet upstream of the latter.

Boilers according to the invention may be of any size and power output, but are particularly advantageous in that they can be made in small sizes such as to give power outputs smaller than those obtainable from currently-known boilers of conventional construction. Domestic boilers of conventional kinds generally give outputs in the approximate range 0.3 to 1.3 megajoule/hr (30,000 to 125,000 bth/hr) (boiler to water). We have obtained results with a boiler of the novel kind described herein, in which the heat exchanger diameter was about 0.38 meter (15 inches) and the length of its body about 9 cm (3¾ inches). A figure of 0.121 megajoule/hr (11,500 btu/hr) was obtained for the boiler output into water flowing at the rate of about 41 Kg/min (9 lb/min). Both the combustion efficiency and gas-to-water efficiency were comparable with those obtainable with conventional boilers. Another similar boiler of comparable size gave a boiler output of 0.221 megajoule/hr (20,900 btu/hr) into water flowing at the rate of 34 Kg/min (7.5 lb/min), again with satisfactory efficiencies.

As to boiler size, it will be evident from the heat exchanger dimensions quoted above that a boiler of the kind described herein can be made to overall dimensions such that its overall volume is similar to that of a conventional boiler having the same power output; and that the overall size of the boiler, when made so as to give smaller power outputs than the conventional types, will be correspondingly smaller.

Accordingly, from the point of view both of power output and of overall size, the boilers as described herein can be seen to be useful, not only as an alternative to conventional boilers, but more especially as an economically-viable means for obtaining hot water and central heating in very small dwellings where the total hot water requirement is not sufficient to justify a conventional boiler.

The boiler may be made free-standing, or arranged for mounting on a wall, or even for example inside a suitable cupboard. They may be readily adapted for use with either gas or fuel oil, or with any other suitable fuel.

Embodiments of the invention are described in the Specific Description, by way of example only, with reference to the drawings.

SPECIFIC DESCRIPTION

Figure 1:
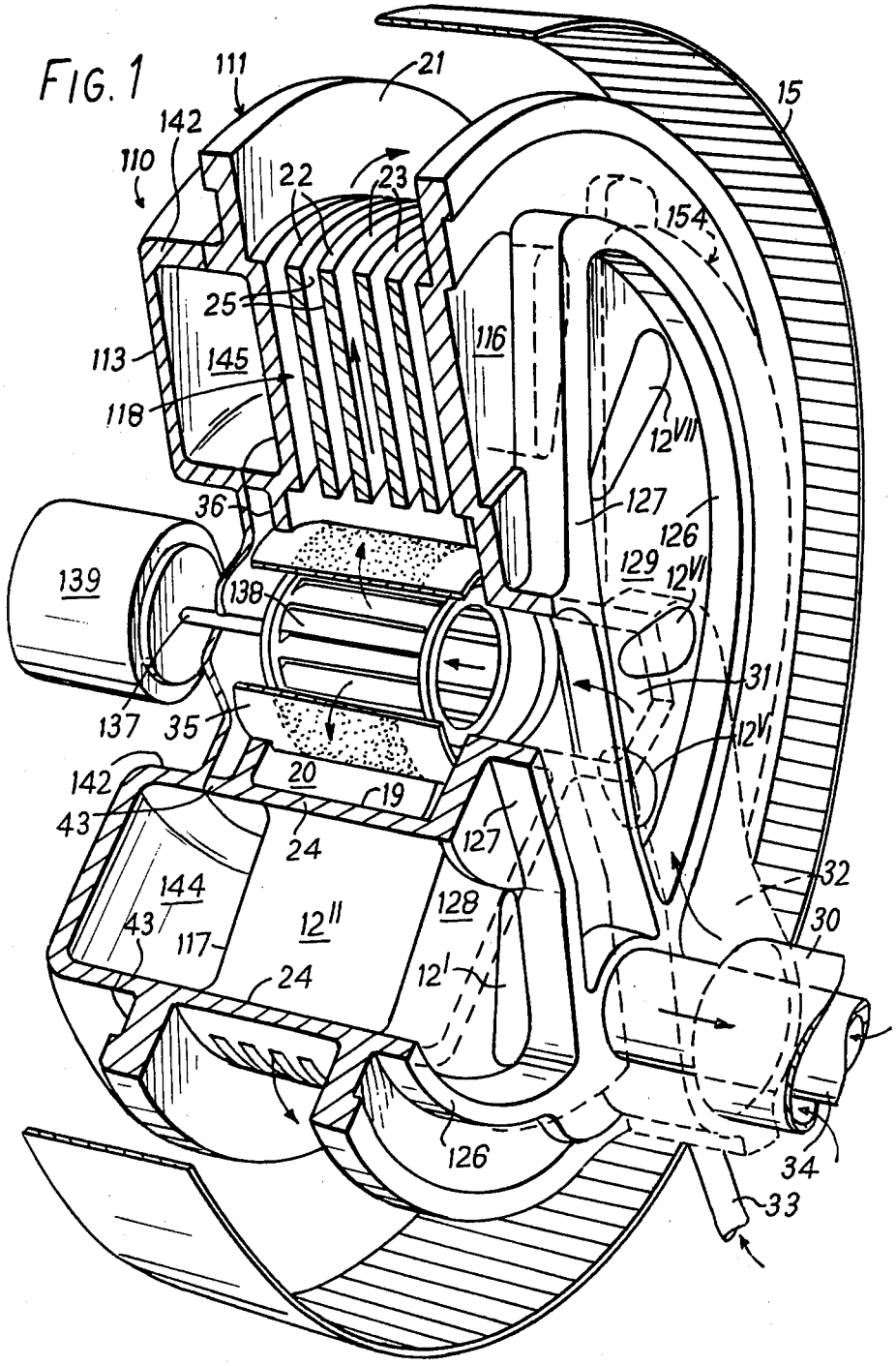
FIG. 1 is a partly diagrammatic, cut-away view in perspective showing principal components of a central heating boiler which is not an embodiment of the invention.

In the following description two embodiments of the invention are described, but first there will be described with reference to FIGS. 1 and 2 a boiler having a heat exchanger 110, thereafter a first embodiment of the invention will be described with reference to FIGS. 3 to 7 and having a heat exchanger 210, and a second with reference to FIG. 8, the third embodiment being the same as the first embodiment except as will be described. For ease of identifying the parts of the boiler which differ from one embodiment to another, the following notation is used for the reference numerals so far as practicable. Two-figure numerals relate to parts common to all the embodiments, while three-figure numerals between 100 and 199 are used for parts described only in respect of the boiler shown in FIGS. 1 and 2. Three-figure numerals between 200 and 299 are used for parts first described with respect to the first embodiment (some of these appear also in FIG. 8); whilst parts described only for the second embodiment are identified by numerals between 300 and 399. Where two parts in two of the boilers to be described, whilst different in some way from each other, nevertheless have the same or a similar function, the last two figures of their reference numerals are, in general, the same for both parts.

Referring to FIG. 1, a small domestic gas-fired boiler for producing hot water, for central heating and for supply to hot water taps, includes a heat exchanger generally indicated at 110. The heat exchanger 110 is arranged for indirect heat exchange between a first fluid medium, in the form of hot products of the combustion of gas, and a second fluid medium which is the water to be heated. The heat exchanger 110 comprises a generally cylindrical, hollow heat exchanger body member 111 in which are formed longitudinal water passage means. These latter take the form of eight waterways 12, of pear-shaped cross-section. As will be seen hereinafter, the heat exchanger 110 is adapted for flow of the hot combustion products (hereinafter referred to as "hot gas") away from the axis of the heat exchanger body 111 and towards its circumference.

Figure 2:
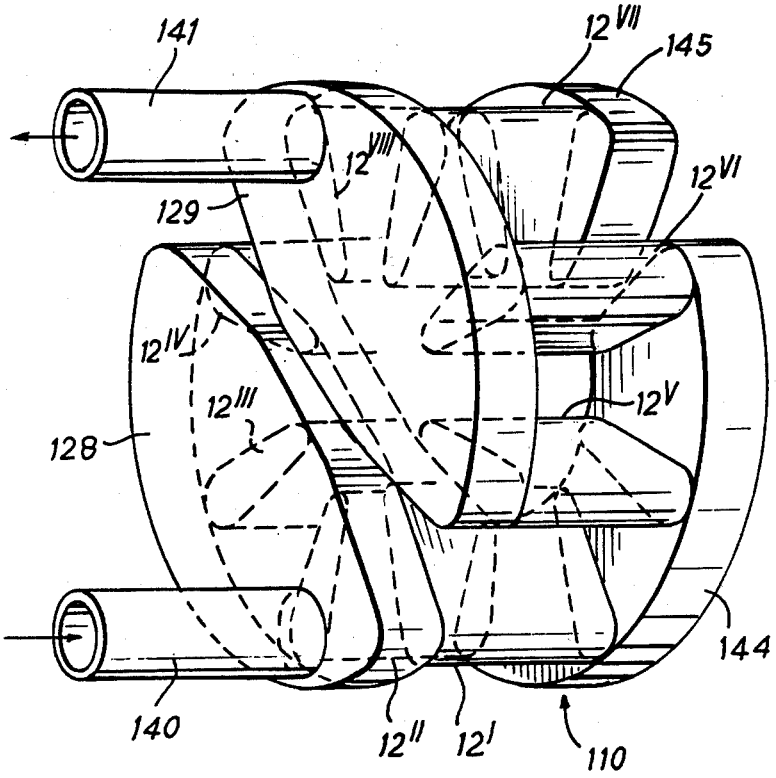
FIG. 2 is a diagrammatic representation illustrating the water circuit of the heat exchanger of the boiler shown in FIG. 1.

Describing the heat exchanger in greater detail with reference to FIGS. 1 and 2, it consists of four principal parts, viz. the heat exchanger body member 111, a front cover member 113, a rear cover member indicated at 154 in phantom lines in FIG. 1, and a circumferential shroud 15. The body member 111 consists, in this example, of a single, generally cylindrical body member which is a one-piece iron casting. The body member 111 has disc-like front and rear walls 117 and 116 respectively, between which there is situated a toroidal heat exchange matrix 118 through which the waterways 12 extend. At its radially inner edge the heat exchange matrix 118 defines a central, coaxial bore 19 of the heat exchanger body member; the central space within this bore constitutes a combustion chamber 20. The front and rear walls 117,116 extend radially outwards beyond the circumference of the heat exchange matrix 118, so that there is between them an annular, circumferential space 21. This space 21 is closed by the encircling shroud 15, which is shown in FIG. 1 spaced away from the heat exchanger body 111 but which in the assembled heat exchanger is sealingly secured around the latter by any suitable means (not shown). The annular space 21 serves as a hot gas collecting or outlet manifold chamber.

The matrix 118 comprises a plurality of annular walls 22 which are disposed in radial planes and which separate a number of annular passages 23. The passages 23 lead directly and radially from the combustion chamber 20 to the hot gas collecting chamber 21, and are interrupted only by the longitudinally extending walls 24 which enclose the waterways 12. The bore 19 is thus surrounded by radially extending direct and indirect heat exchange surfaces defining annular paths for the hot gas along the passages 23, these heat exchange surfaces being the radial sides 25 of the walls 22 and of the end walls 117,116 in the matrix, together with those surfaces (not shown) of the longitudinal walls 24 which are exposed to the hot gas.

It will be noted that hot gas is able to flow through the matrix freely in radial directions (and to this end the annular passages 23 are free of any obstruction such as to reduce the flow rate), but are constrained by the annular heat exchange surfaces of the matrix against movement in axial directions. Thus the hot gas is positively guided in true radial flow through the matrix 118.

The rear wall 116 of the heat exchanger body 111 has on its outer surface two integral, arcuate flanges 126 projecting longitudinally, the ends of each of the flanges 126 being joined by an integral flange 127. The flanges 126,127 are matched by, and abut, corresponding flanges of the rear cover member 154, so that the end wall 116 and cover member 154 together enclose a cold water inlet chamber 128 and a hot water outlet chamber 129.

The boiler has air inlet means in the form of an inlet pipe 30 leading into a mixing chamber 31 which is bounded by a wall 32 of the rear cover member 154, by the heat exchanger rear wall 116, by part of each of the flanges 127, and by corresponding parts of the cover member flanges (not shown in FIG. 1) abutting with the latter. A fuel gas inlet 33 is provided to introduce gas into the inlet end of the mixing chamber 31, and the outlet end of the latter, on the axis of the heat exchanger, opens into the combustion chamber 20.

A hot gas exhaust pipe 34 is arranged coaxially within the air inlet pipe 30 but does not communicate therewith. The exhaust pipe 34 is fixed through the heat exchanger rear wall 116 and leads from the hot gas collecting manifold 21; it is arranged to be connected, by any suitable means not shown, to a conventional flue. It will however be realised that, with this coaxial arrangement of the two pipes 30 and 34, a balanced flue can very conveniently be provided.

A cylindrical burner 35 of known pattern is mounted coaxially in the combustion chamber 20, the latter being provided with an annular locating flange 36 for this purpose.

The front end of the combustion chamber is closed by the front cover member 113, through which there extends a drive shaft 137 carrying a fan 138. The latter is mounted coaxially within the burner 35, and its shaft 137 is driven by an externally-mounted electric motor 139.

The water circuit of the heat exchanger is illustrated diagrammatically in FIG. 2. The boiler has water inlet means in the form of a cold water pipe 140 leading into the inlet chamber 128 (FIGS. 1 and 2), and water outlet means in the form of a hot water pipe 141 leading from the outlet chamber 129 (FIGS. 1 and 2). The inlet chamber 128 leads into a first group of four of the longitudinal waterways of the heat exchanger, indicated at $12^{I}$, $12^{II}$, $12^{III}$ and $12^{IV}$ in FIG. 2. The front cover member 113 is arranged with longitudinally projecting flanges such as 142, FIG. 1, abutting corresponding flanges, such as 43, of the front wall 117 of the heat exchanger, so that a pair of separate water manifold chambers 144,145 are formed between the front cover member 113 and the front wall 117. The waterways $12^{I}$ and $12^{II}$ lead into the manifold chamber 144, whilst the waterways $12^{III}$ and $12^{IV}$ lead into the manifold chamber 145. Leading from the chamber 144 to the hot water outlet chamber 129 are two further ones of the waterways 12, viz. those indicated at $12^{V}$ and $12^{VI}$. The two remaining waterways, $12^{VII}$ and $12^{VIII}$, lead from the other manifold chamber 45 to the hot water outlet chamber 129. The four waterways $12^{V}$, $12^{VI}$, $12^{VII}$, $12^{VIII}$ thus constitute a further group to return the water through the heat exchanger to the rear end of the latter.

The boiler itself comprises the heat exchanger 110, the air inlet pipe 30, hot gas exhaust 34, burner 35, fan 138 with its shaft 137 and motor 139, and other necessary but conventional parts (not shown), such as an igniter in the combustion chamber, electrical control equipment, fuel gas valve, thermostat etc. The heat exchanger 110 is fixed on a suitable mounting within a cabinet, not shown, in which the other components can conveniently be also arranged.

In operation, water passing first through the waterways $12^{I}$ to $12^{IV}$ and then through the waterways $12^{V}$ to $12^{VIII}$ is heated by cross-flow heat tranasfer from the hot gases forced radially through the annular passages 23 of the heat exchanger matrix 118 by the fan 138, as indicated by arrows in FIG. 1. The hot gases are of course the product of combustion, at the burner 35, of the gas-air mixture created in the mixing chamber 31.

Referring now to FIGS. 3 to 7, these Figures illustrate parts of the modified heat exchanger 210 for a boiler which, in all respects other than those which will be evident from the description now to follow, and from the drawings, is constructed, and operates, in the same way as that described with reference to FIGS. 1 and 2.

Figure 3:
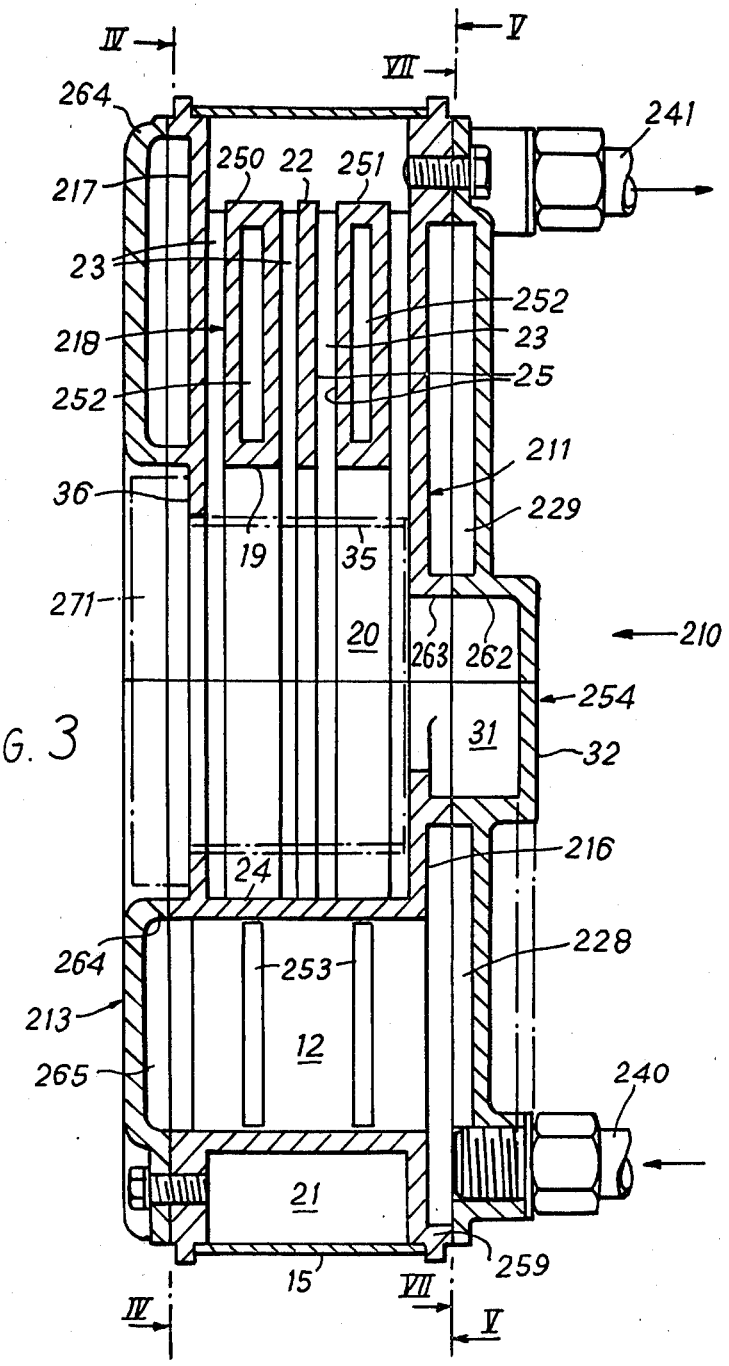
FIG. 3 is a sectional elevation, taken on the two radial planes represented by the line III—III in FIG. 4, and showing the heat exchanger of a boiler according to the invention.
Figure 4:
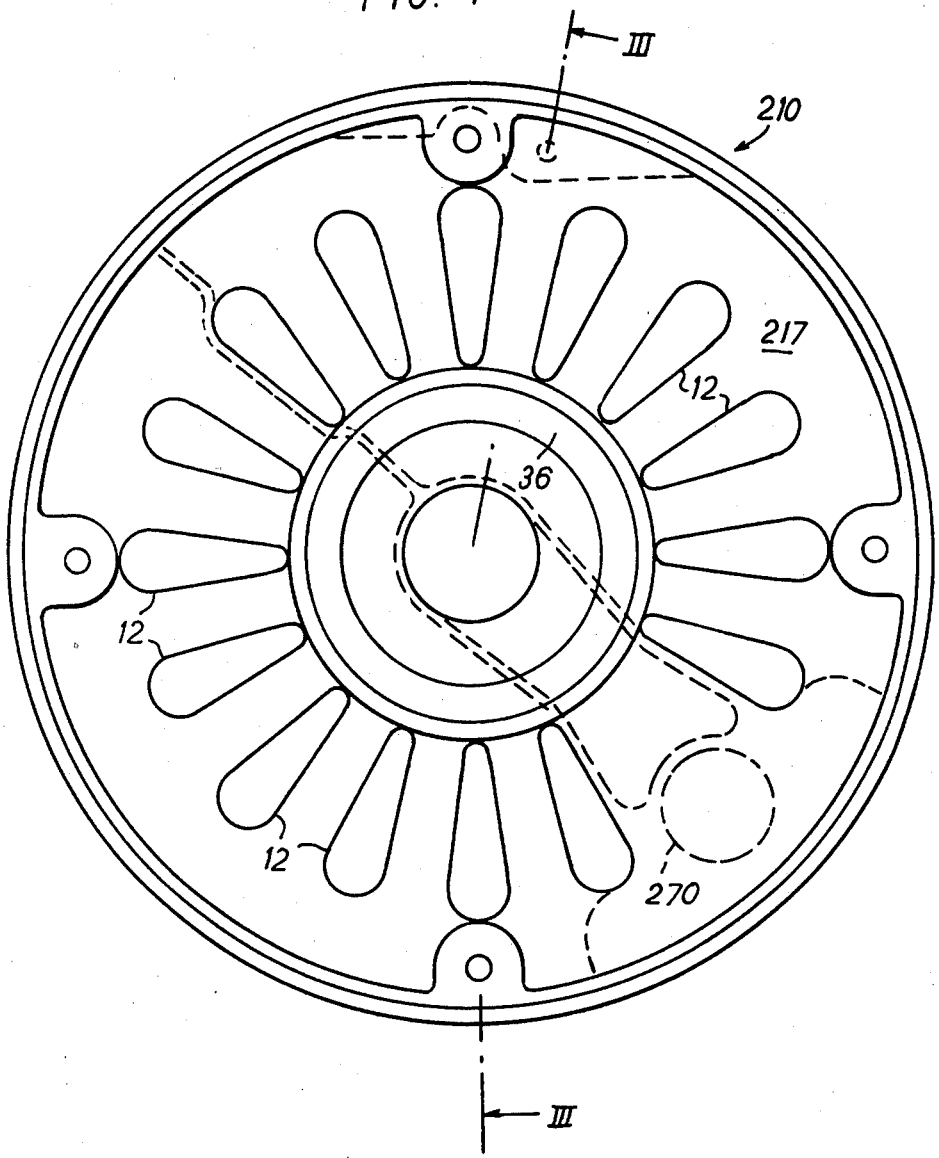
FIG. 4 is an end view of a heat exchanger body member, as seen in the direction, and viewed on the plane, denoted by the arrows IV—IV in FIG. 3.
Figure 6:
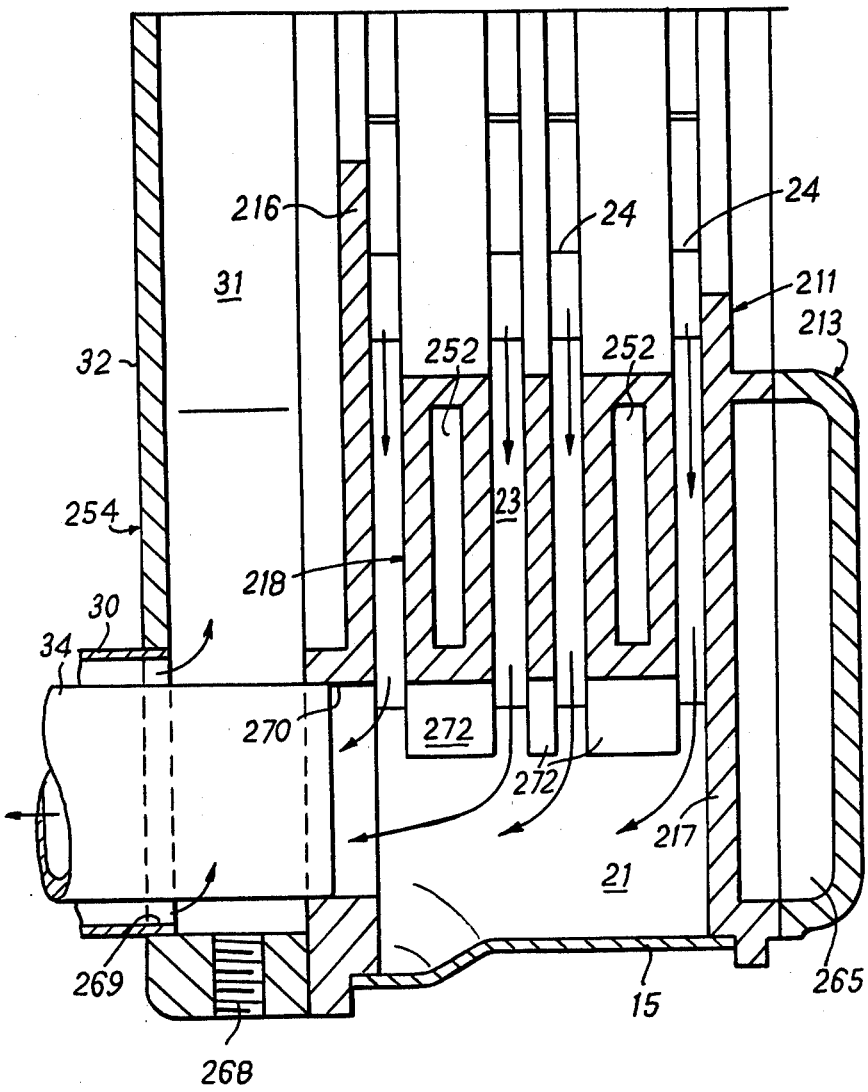
FIG. 6 is a sectional view taken on the plane VI—VI in FIG. 5.

In the heat exchanger matrix 218 seen in FIGS. 3 and 6, two of the annular walls, shown at 250 and 251, are thicker than the walls 22 in the embodiment of FIG. 1, and are made hollow to define in each wall 250,251 an internal, annular water passage 252. The passages 252 communicate with the waterways 12 by means of ports 253 through the longitudinal walls 24 of the latter. This causes some water to be diverted from the waterways 12 into the passages 252.

Figure 5:
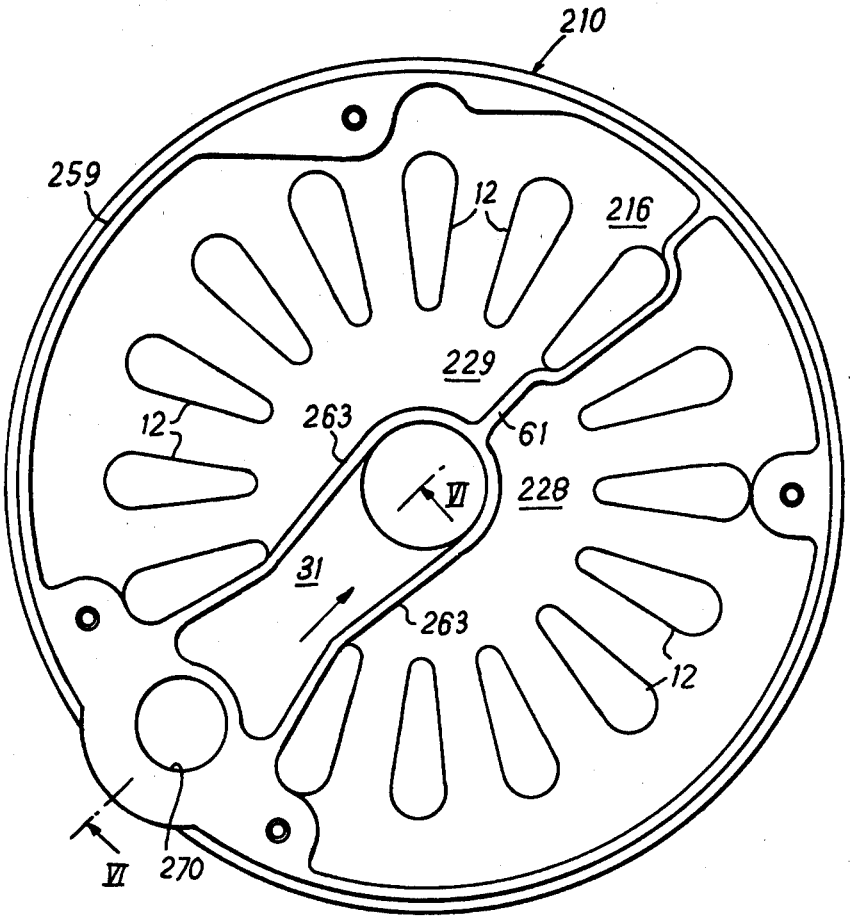
FIG. 5 is a view similar to FIG. 4 but shows the other end as seen in the direction, and viewed on the plane, denoted by the arrows V—V in FIG. 3.
Figure 7:
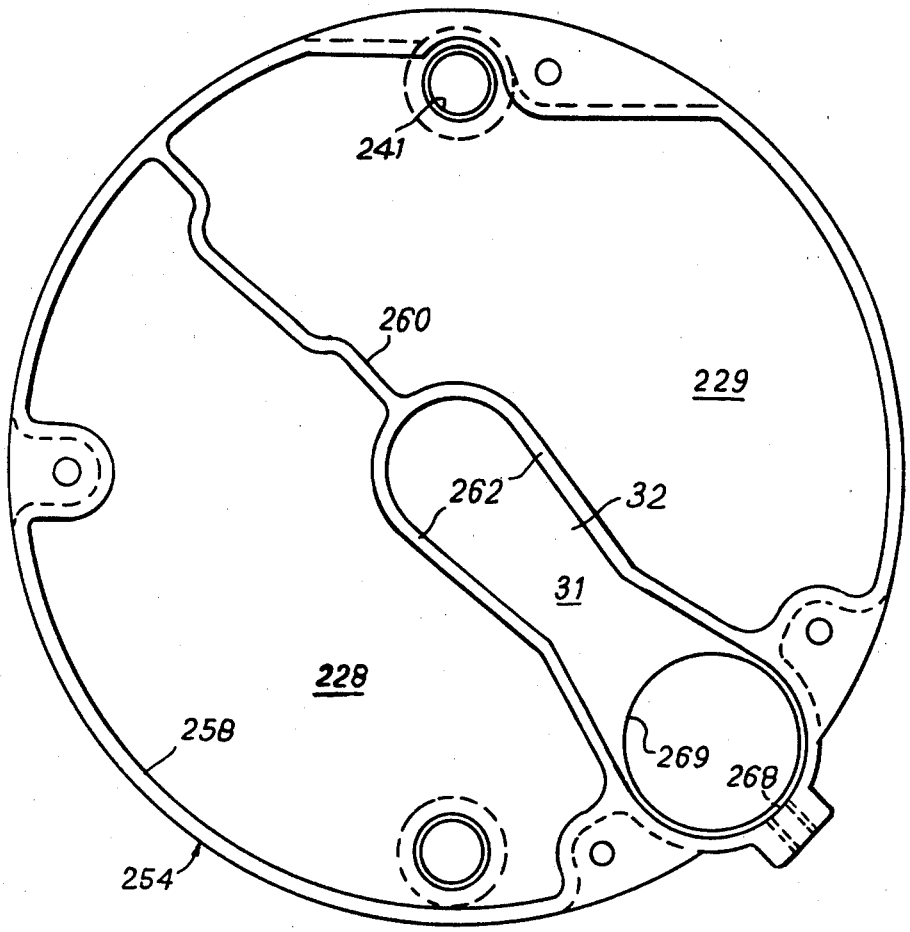
FIG. 7 is an inside view of a rear cover plate of the heat exchanger, as seen in the direction, and viewed on the plane, denoted by the arrows VII—VII in FIG. 3.

The matrix 218 has fifteen waterways 12, divided into two groups, viz. a first group of seven leading water from the rear of the heat exchanger to the front, and a second group of eight through which the water is returned to the rear. The respective water inlet and outlet chambers 223 and 229 are again bounded by the rear cover member, 254, and the rear wall, 216, of the heat exchanger 210, and by mating flanges 258,259; 260,261; and 262,263 respectively of the cover member 254 and end wall 216 (FIGS. 3, 5 and 7). However, the front cover member 213, FIG. 3, has a pair of coaxial flanges 264 defining a single annular manifold chamber 265, in place of the two chambers 144,145 of FIGS. 1 and 2.

It will be understood that the annular water passages 252 need not each be provided with fifteen ports 253, i.e. one for every one of the waterways 12. The ports 253 can if desired be provided, in respect of each of the passages 252, at only some of the waterways 12; selection of waterways for provision of these ports can be made having regard to the most desirable water flow pattern, to ensure that all the water is heated adequately whilst avoiding stagnation within the passages 252.

The hot water outlet pipe is shown at 241 in FIGS. 3 and 7, and the cold water inlet pipe at 240. The mixing chamber 31 is arranged between the mating flanges 262 of the rear cover member and 263 of the heat exchanger rear wall, the fuel gas inlet being indicated at 268 in FIG. 6. An opening 269 is provided in the rear cover member 254 for the air inlet pipe 30, FIG. 6, to be sealably fixed therein, whilst an opening 270 is formed in the heat exchanger rear wall 216, FIGS. 5 and 6, for the hot gas exhaust pipe 34. The front end of the combustion chamber 20 is closed by an end plate indicated by phantom lines at 271 in FIG. 3.

It will also be noted from FIG. 6 that the annular walls 22,250,251 of the heat exchanger matrix 118 may advantageously be cut away to form recesses 272 in their outer circumference, opposite the hot gas exhaust 34, to permit smooth flow of the hot gas at this point.

Figure 8:
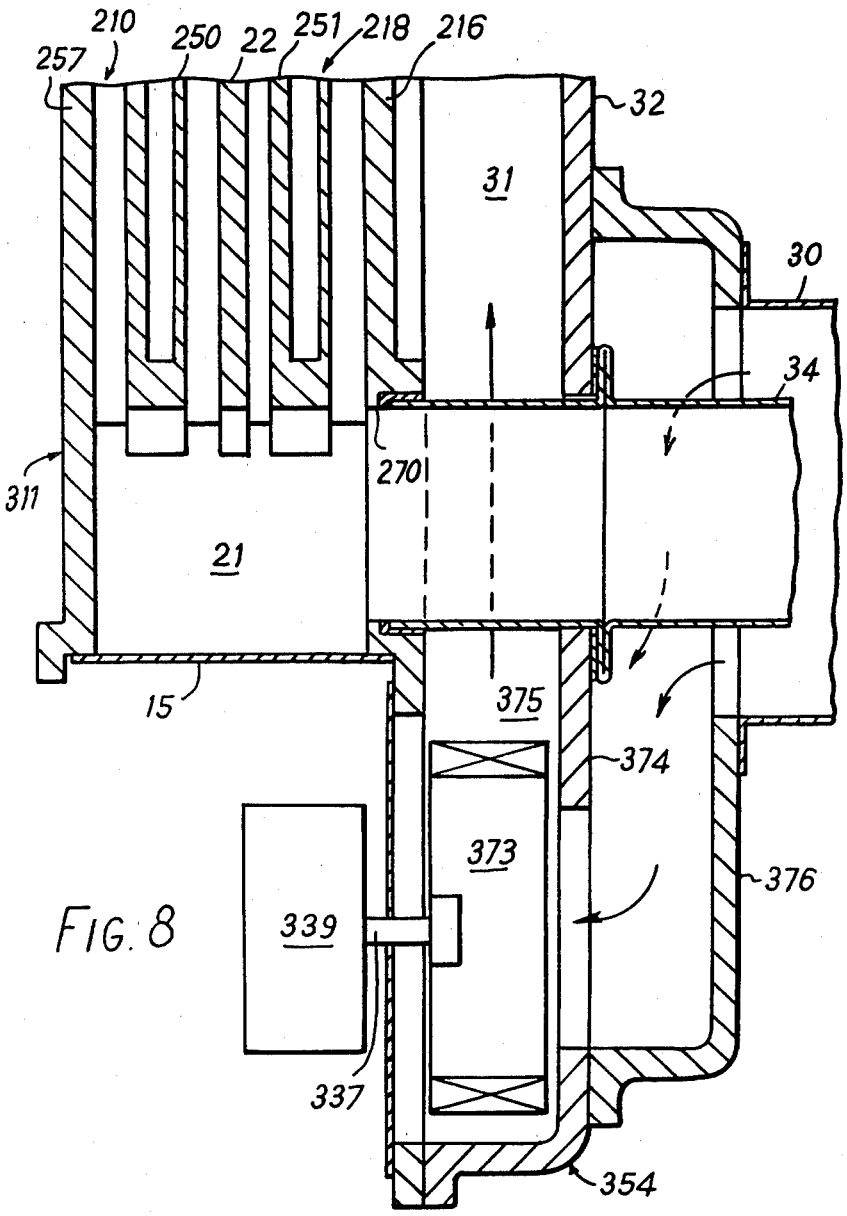
FIG. 8 is a scrap section showing how, the fan in the combustion chamber may be replaced by a blower external to the heat exchanger.

Referring now to FIG. 8, this shows a modification in which, in place of the fan 138 in the combustion chamber of the boiler shown in FIG. 1 and provided in the boiler described with reference to FIGS. 3 to 7, a blower 373 is provided in the air inlet means to induce a forced draught through the boiler. In this example, the rear cover member, 354, is extended radially beyond the heat exchanger 210, as indicated at 374, to provide a blower chamber 375 which is an extension of the mixing chamber 31. The blower 373 is arranged in the chamber 375, its motor 339 being mounted on the outside of the latter. Air from the inlet pipe 30 is diverted to the blower 373 through a small auxiliary chamber 376 fixed to the cover member 354.

Many variations, besides those already described, may be made to the boilers and heat exchangers described herein. For example, the water inlet and water outlet may be at the front end of the heat exchanger; alternatively the inlet may be at one end and the outlet at the other. The waterways through the heat exchanger matrix, and the chambers connecting these waterways at their ends, may be so arranged with respect to each other that water passes through the heat exchanger in a single pass or in more than two passes. There may be any desired number of waterways, and these may be of any suitable cross-section. There may be any desired number of annular walls in the heat exchanger matrix, and consequently any number of annular or radial hot gas passages through the matrix. The heat exchanger body need not consist of a single body member, but may comprise more than one such member, bolted in end to end relationship.

I claim:

1. A boiler for producing hot water, said boiler comprising a heat exchanger, for indirect heat exchange between hot gaseous combustion products, the heat exchanger having a generally-cylindrical hollow body including a heat exchange matrix (118) and comprising at least one generally-cylindrical body member having a central bore (19) defining a combustion chamber (20), and a plurality of radial surfaces (25) defining annular gas passages (23) for flow of the combustion products therethrough, said annular gas passages being narrow in relation to their radial extent and leading radially from the central bore towards combustion product outlet means in the form of an annular circumferential space (21) encircling the heat exchange matrix, some of said radial surfaces being the sides of at least one radial wall (22, 250, 251) separating one said annular gas passage from the next, the said radial surfaces and annular gas passages being intersected by transverse walls enclosing longitudinal water passages (12); a burner (35) associated with the combustion chamber for producing said combustion products; water inlet means and water outlet means communicating with the said longitudinal water passages (12); air inlet means to the combustion chamber; and a fan (138) for creating a forced draught in said air and combustion product, characterised in that said at least one radial wall (250,251) of the heat exchanger matrix is hollow by virtue of an internal water bypass passage (252) extending circumferentially therein, said annular water bypass passage being in communication with the longitudinal water passages (12) but not with the annular gas passages (23), so that water not only passes longitudinally along the longitudinal water passages, but also circumferentially through the bypass passage so as to circulate in the hollow wall or walls, a cylindrical burner (35) within the combustion chamber (20), and said burner being arranged coaxially around said fan (138).

* * * * *